US011613038B2

(12) United States Patent
Chen

(10) Patent No.: US 11,613,038 B2
(45) Date of Patent: Mar. 28, 2023

(54) FOLDING CUTTING MAT

(71) Applicant: Chi-Jen Chen, Xihu Township, Changhua County (TW)

(72) Inventor: Chi-Jen Chen, Xihu Township, Changhua County (TW)

( * ) Notice: Subject to any disclaimer, the term of this patent is extended or adjusted under 35 U.S.C. 154(b) by 0 days.

(21) Appl. No.: 17/394,129

(22) Filed: Aug. 4, 2021

(65) Prior Publication Data

US 2023/0038715 A1 Feb. 9, 2023

(51) Int. Cl.
*B26D 7/20* (2006.01)

(52) U.S. Cl.
CPC ..... *B26D 7/20* (2013.01)

(58) Field of Classification Search
CPC ... B26D 7/20; A47J 47/00; A47J 47/04; A47J 47/005; B23Q 1/037; B27Q 3/00; B27Q 3/03
USPC ..... 83/658; 29/559
See application file for complete search history.

(56) References Cited

U.S. PATENT DOCUMENTS 3,448,913 A * 6/1969 Wolff ..... A47J 47/00 220/62.21
5,938,449 A * 8/1999 Masson ..... B43L 1/12 434/408
6,183,833 B1 * 2/2001 Robbins, III ..... B26F 1/44 428/167
6,241,085 B1 * 6/2001 Koehn ..... G11B 33/0494
2002/0105143 A1 * 8/2002 Elliott ..... A63F 3/0023 273/285
2003/0152908 A1 * 8/2003 Lopez ..... B43L 1/00 434/408
2005/0193407 A1 * 9/2005 Lessard ..... G11B 23/0014 720/728
2005/0269224 A1 * 12/2005 Giatsiakis ..... G11B 33/045
2007/0082177 A1 * 4/2007 Robbins ..... A47G 27/0206 428/167
2008/0173557 A1 * 7/2008 Chou ..... A45D 33/22 206/308.1
2015/0307165 A1 * 10/2015 Patton ..... B63B 32/53 441/74

* cited by examiner

*Primary Examiner* — Evan H MacFarlane
*Assistant Examiner* — Fernando A Ayala
(74) *Attorney, Agent, or Firm* — Egbert, McDaniel & Swartz, PLLC

(57) ABSTRACT

Disclosed is a folding cutting mat. As its main features, the folding cutting mat includes more than one 4-piece folding unit, the single 4-piece folding unit includes a folding face and a flipping face integrally formed, wherein the folding face includes left and right side faces and a first folding line to connect the left and right side faces, the flipping face includes left and right side plates and a separating gap to separate the left and right side plates; the left side face and left side plate are connected through a second folding line, the right side face and the right side plate are connected through a third folding line. With the size of the folded 4-piece folding unit reduced to one fourth of the size in the unfolded state, the size of the folded cutting mat is considerably reduced to facilitate transportation and storage.

2 Claims, 7 Drawing Sheets

FOLDING CUTTING MAT

CROSS-REFERENCE TO RELATED U.S. APPLICATIONS

Not applicable.

BACKGROUND OF THE INVENTION

1. Field of the Invention

The present invention relates generally to a cutting mat, and more particularly to an innovative structural design of a folding cutting mat.

2. Description of Related Art Including Information Disclosed Under 37 CFR 1.97 and 37 CFR 1.98

When using a handheld cutter for cutting operations, people usually put a cutting mat beneath the object to be cut, so as to avoid damage to the table or the cutter itself when the object is cut through.

There are a variety of cutting mats on the market. The present invention aims to improve the structural design of folding cutting mats. The prior-art folding cutting mats commonly seen on the market are two-face folding mats. When a large area is required for the cutting mat, for example, if the fully open size is 758 mm×1060 mm, after folding, the size can only be reduced to 530 mm×758 mm. This folded area is still too large for users and is not convenient to carry around, and cannot meet the needs for easy transportation by the transient population derived by the Internet community.

A cutting mat is not as thin as a paper that can be folded easily. It has a thickness ranging from 1 mm to 3 mm, and has a certain rigidity. Therefore, it is not possible to realize multiple folds directly using the folding structure of the prior-art cutting mats. This is a technical bottleneck facing the related industry.

Hence, it is the expectation of users and the aim of manufacturers to develop an innovative structural design of a cutting mat that can solve the problem of the prior art, and that offers more practicability. In view of this, the inventor has made deliberate research, evaluation and design based on years of experience in the development and design of related products, and has developed the present invention of practicability that realizes the above-mentioned aim.

BRIEF SUMMARY OF THE INVENTION

The main object of the present invention is to provide a folding cutting mat. The invention aims to make a breakthrough in solving the technical problems and to develop an innovative, ideal and practical new style of folding cutting mat.

Based on the above object, the present invention provides a folding cutting mat, which includes more than one 4-piece folding unit. A single 4-piece folding unit includes a folding face and flipping face formed integrally and connected to each other. The folding face includes a left side face, a right side face and a first folding line connecting the left and right side faces. The flipping face includes a left side plate, a right side plate and a separating gap to separate the left and right side plates; the left side face and the left side plate are connected through a second folding line, and the right side face and the right side plate are connected through a third folding line.

Based on the above innovative structural design and technical features, the present invention provides more advantages than the prior art. When using the folding cutting mat, the left side face and right side face can be folded together using the first folding line as the bending portion, the left side plate can be folded onto the left side face using the second folding line as the bending portion, and the right side plate can be folded onto the right side face using the third folding line as the bending portion. In this way, the size of one single 4-piece folding unit in the folded state is only one fourth of the unfolded state. After folding, the area of the cutting mat is greatly reduced. A large cutting mat can be folded in a similar way to reduce its size for convenient transportation and storage. This is indeed a practical advancement and has great value for industrial utilization.

Another object of the invention is to provide a solution to extend the size of the cutting mat by connecting a plurality of 4-piece folding units. A second separating gap is formed between the left side face and the right side face of the two adjacent 4-piece folding units abutting each other, and a fourth folding line is formed between the left side plate and the right side plate of the two adjacent 4-piece folding unit connecting each other. This feature of the invention enables limitless area extension of the cutting mat while maintaining the folding function. It is truly a practical inventive step.

Another object of the invention is to provide a solution to enhance tightness, smoothness and stability of the cutting mat through the formation of a male locking portion and a female locking portion respectively on the left side plate and right side plate of the flipping face to lock each other, so that the cutting operation becomes safer. This offers another advantage and practical inventive step.

A further object of the invention is to provide a solution for easy hanging and storage of the cutting mat by designing the male locking portion into a shape of a hook. Thus, when the 4-piece folding unit is folded, the hook-shaped male locking portion can be used for hanging. This technical feature is particularly useful.

DETAILED DESCRIPTION OF THE INVENTION

Figure 1:
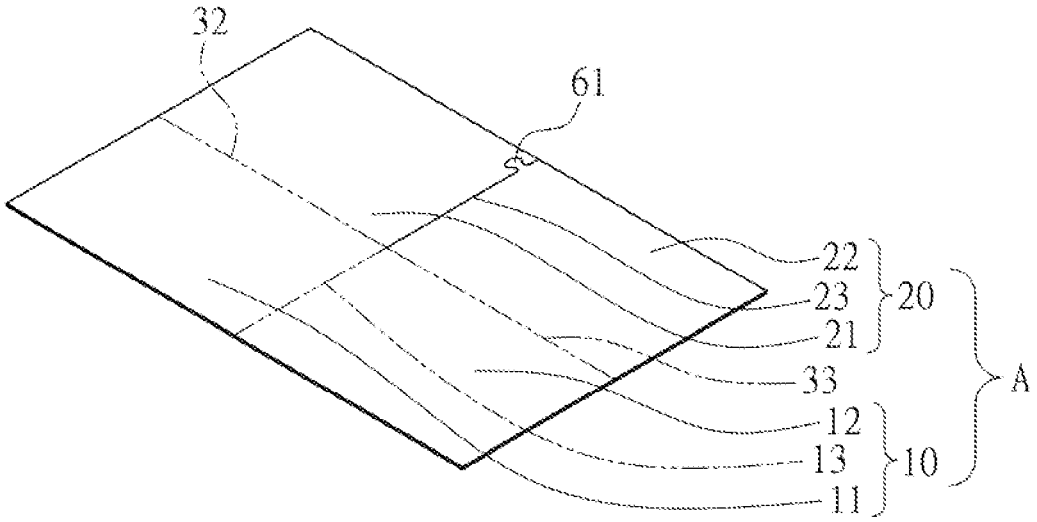
FIG. 1 is a perspective view of the unfolded state of a preferred embodiment of the invention.

FIG. 1 to FIG. 6 show a preferred embodiment of the folding cutting mat according to the invention. However, it is to be noted that such an embodiment is for illustration purpose only and is not intending to limit the scope of the invention.

Said folding cutting mat includes more than one 4-piece folding unit A, a single 4-piece folding unit A includes a folding face 10 and a flipping face 20 integrally formed and connected to each other, wherein said folding face 10 includes a left side face 11, right side face 12 and a first folding line 13 connecting the left side face 11 and the right side face 12, and the flipping face 20 includes a left side plate 21, a right side plate 22 and a separating gap 23 to separate the left side plate 21 and the right side plate 22. The left side face 11 and the left side plate 21 are connected through a second folding line 32, and the right side face 12 and the right side plate 22 are connected through a third folding line 33. Thus, when using the folding cutting mat, the left side face 11 and the right side face 12 can be folded using the first folding line 13 as the bending portion, the left side plate 21 can be folded onto the left side face 11 using the second folding line 32 as the bending portion, the right side plate 22 can be folded onto the right side face 12 using the third folding line 33 as the bending portion. In this way, the area of the fully folded 4-piece folding unit A is only one fourth of the area of the unfolded state. (Note: The folding lines in the invention can be, but not limited to a groove made through pressing formation.)

Figure 6:
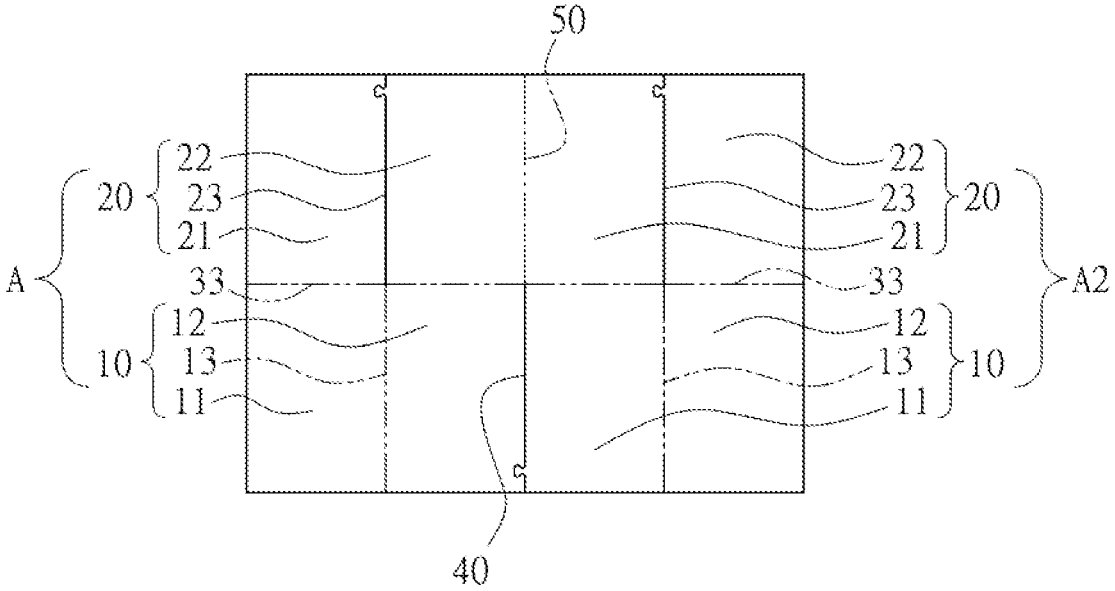
FIG. 6 is a schematic view showing how multiple 4-piece folding units are connected to extend the cutting mat.
Figure 7:
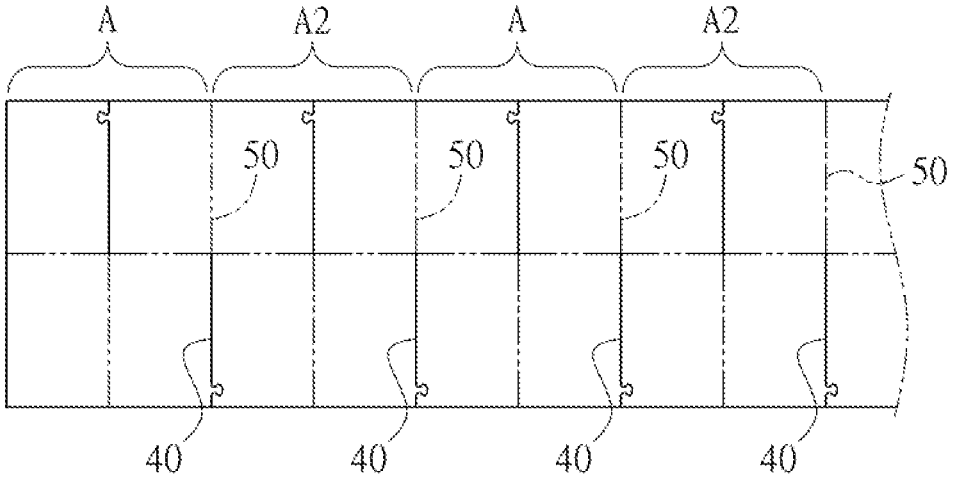
FIG. 7 is an example view showing one derivation from FIG. 6.

Referring to FIG. 6, in this embodiment, when a plurality of 4-piece folding units A, A2 are connected to extend the cutting mat, a second separating gap 40 is formed between the left side face 11 and the right side face 12 of the adjacent two 4-piece folding units A, A2 abutting each other; whereas a fourth folding line 50 is formed between the left side plate 21 and the right side plate 22 of the two 4-piece folding units A, A2 connecting each other. The connection between a plurality of 4-piece folding units A, A2 disclosed in this embodiment enables the folding cutting mat of the invention to have limitless extension while maintaining the folding function. FIG. 7 depicts an embodiment further derived from the above FIG. 6 to meet the needs of related manufactures and consumers for diversified sizes.

Figure 2:
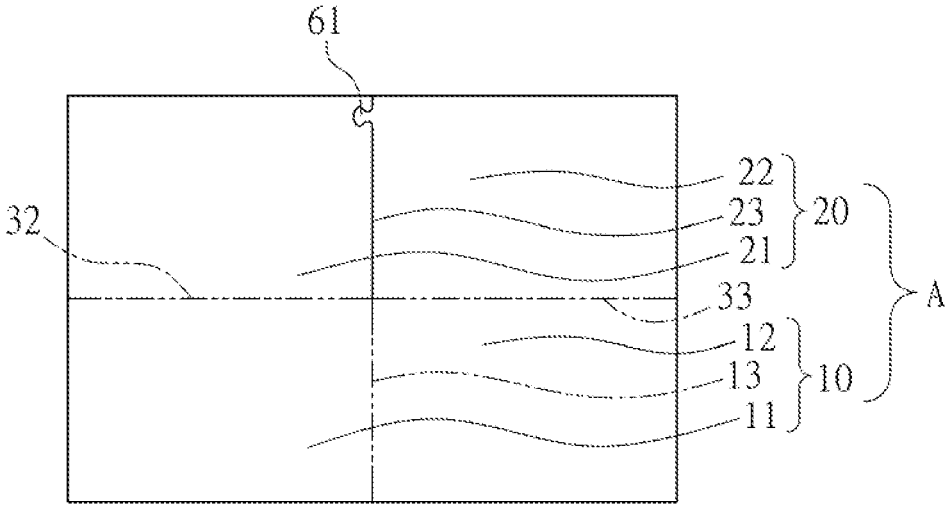
FIG. 2 is a top view of the unfolded state of a preferred embodiment of the invention.
Figure 3:
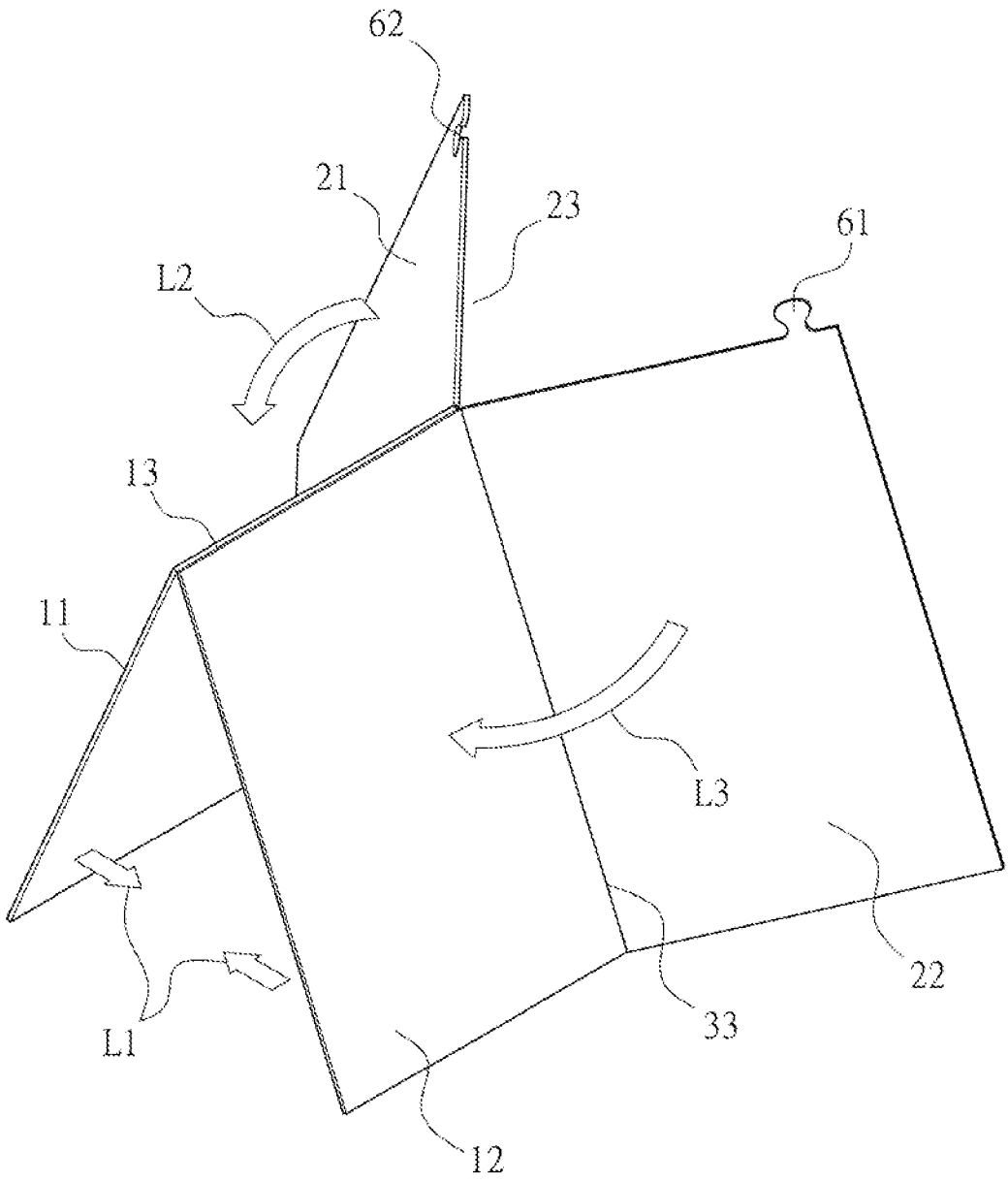
FIG. 3 is a schematic view 1 showing the folding and state changing of a preferred embodiment of the invention.
Figure 4:
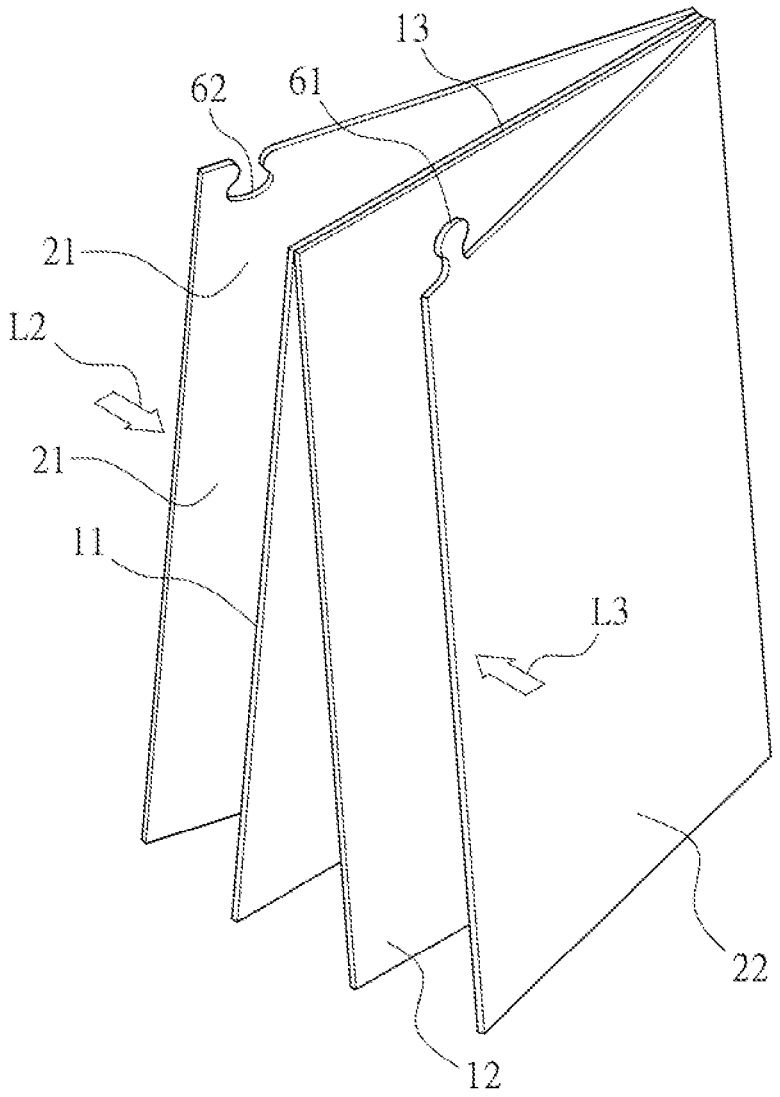
FIG. 4 is a schematic view 2 showing the folding and state changing of a preferred embodiment of the invention.

As shown in FIG. 1 to FIG. 3, in this embodiment, the left side plate 21 and the right side plate 22 of the flipping face 20 are correspondingly formed with a male locking portion 61 and a female locking portion 62 to lock each other, so as to enhance the tightness of abutting, smoothness and stability of the left side plate 21 and the right side plate 22 in the unfolded state. This will also contribute to safer operation.

Figure 8:
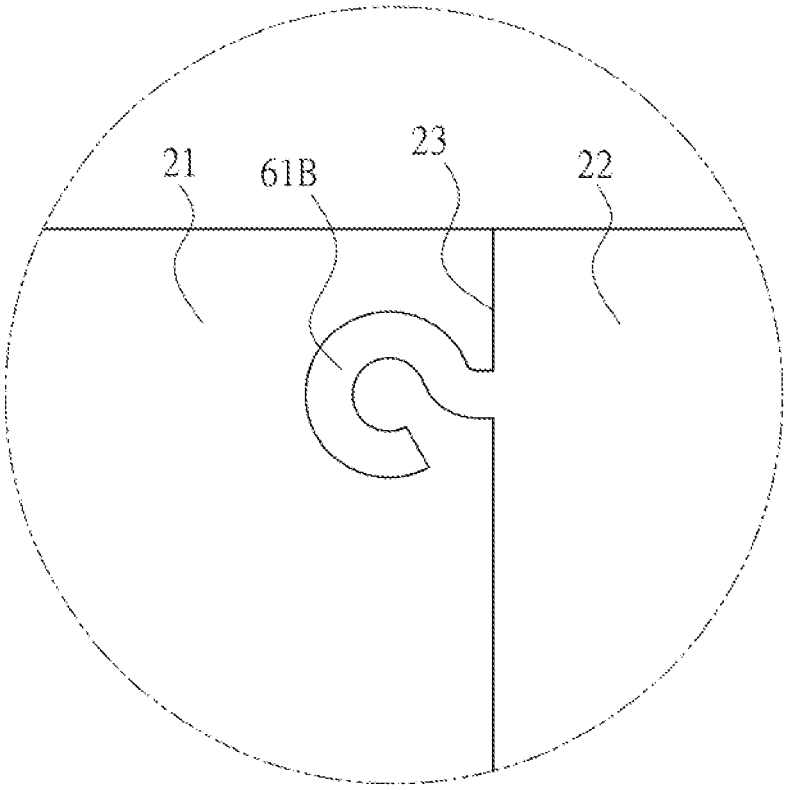
FIG. 8 is a plan view showing the embodiment where the male locking portion is designed in the shape of a hook.
Figure 9:
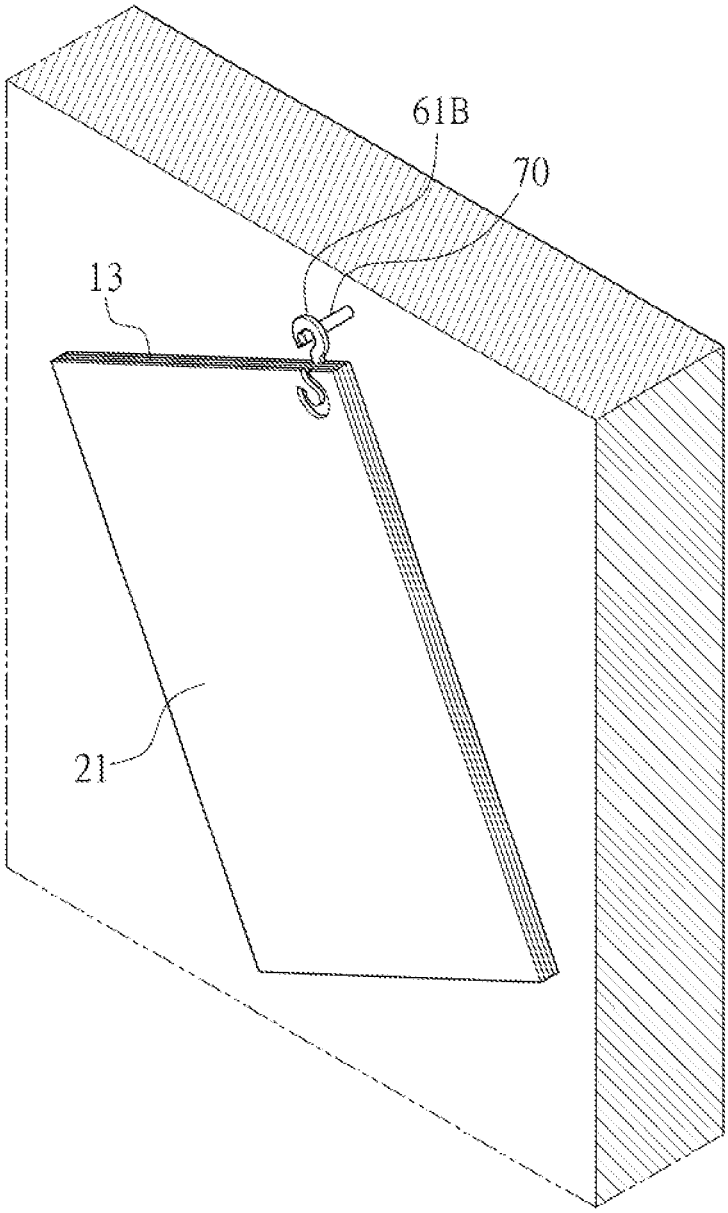
FIG. 9 is a functional view showing the embodiment where the male locking portion is designed in the shape of a hook.

Referring to FIG. 8, in this embodiment, the male locking portion 61B is designed into the shape of a hook. In this way, when the 4-piece folding unit A is folded, the male locking portion 61B in the shape of a hook can act as a hook for hanging (for example, as shown in FIG. 9, it can be hooked on a nail 70 or a hook on the wall or on a cabinet).

Figure 5:
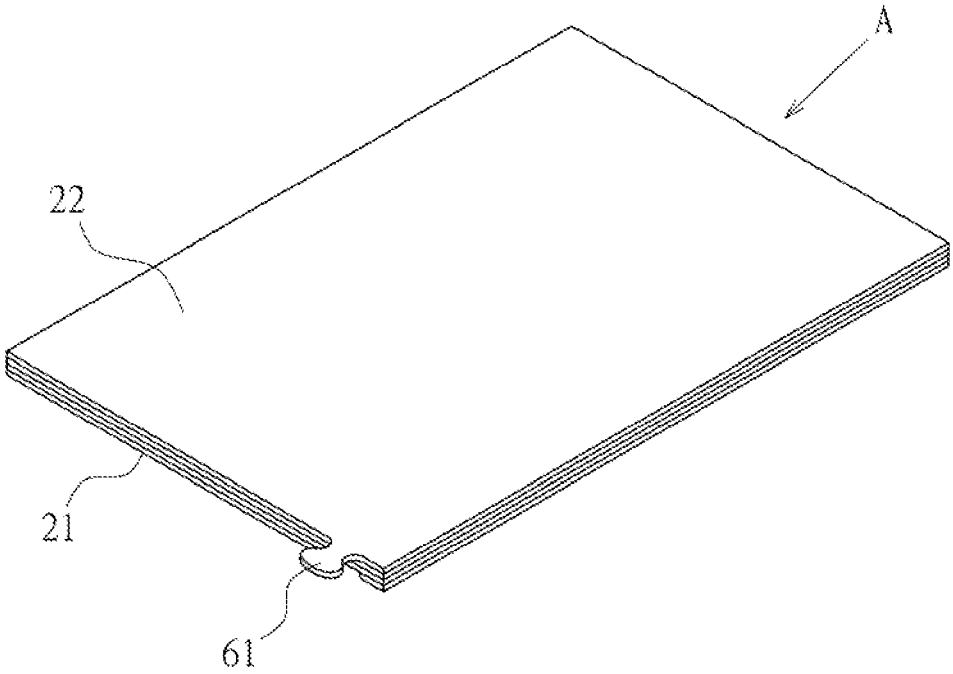
FIG. 5 is a schematic view showing the fully folded state of a preferred embodiment of the invention.

Based on the above structural design and technical features, the folding cutting mat of the invention can be used with great convenience. Let's take the single 4-piece folding unit A shown in FIG. 1 for example. When the user wants to fold the cutting mat, as shown in FIG. 3, firstly the left side face 11 and the right side face 12 can be folded (as indicated by Arrow L1), then the left side plate 21 can be folded toward the left side face 11 (as indicated by Arrow L2 in FIG. 3 and FIG. 4), and in the end the right side plate 22 can be folded toward the right side face 12 (as indicated by Arrow L3 in FIG. 3 and FIG. 4). When the left side face 11, right side face 12, left side plate 21 and right side face 12 are all stacked face to face, the single 4-piece folding unit A is fully folded (as shown in FIG. 5), with the area of the folded state being one fourth of unfolded state; that is to say, if the standard size of the unfolded 4-piece folding unit A is 758 mm×1060 mm, the area of the folded state will be reduced to a quarto size (i.e., 379 mm×530 mm). Such a size will obviously provide much more convenience for users to carry or store.

Figure 10:
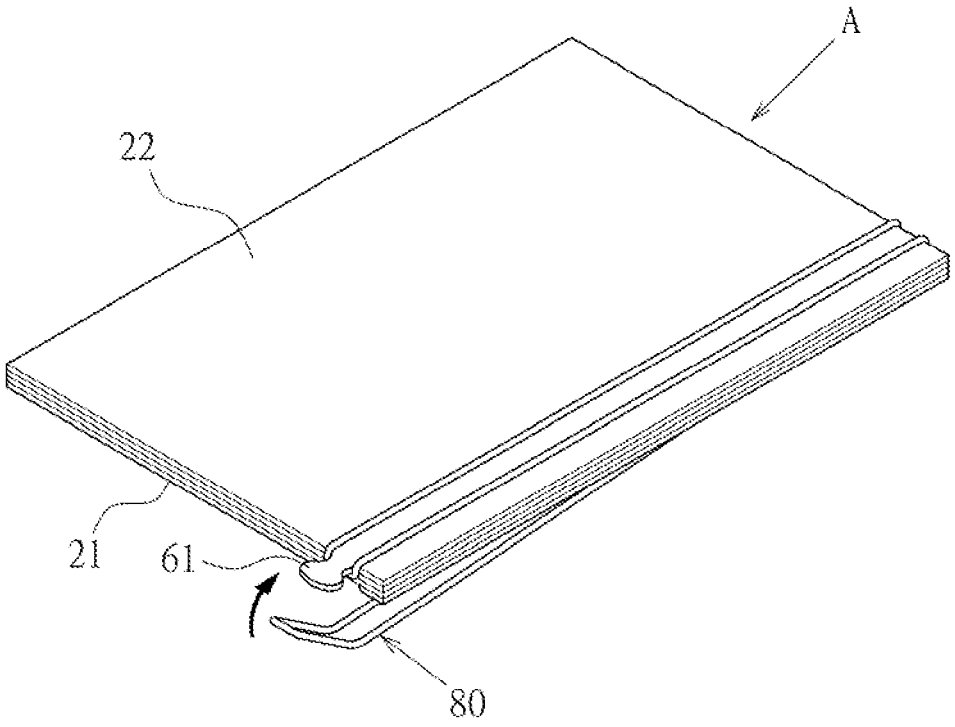
FIG. 10 is an embodiment view showing the folded state of the 4-piece folding unit of the invention, and the male locking portion being used as the winding portion for an elastic ring to tie up the cutting mat.

Referring to FIG. 10, in this embodiment, when the 4-piece folding unit A is folded, the protruding male locking portion 61 can be used as a binding portion. An elastic ring 80 (or other similar objects like an elastic cord or a flexible cable) can be used to bind outside the 4-piece folding unit A and on the male locking portion 61, so that the folded 4-piece folding unit A can be fastened to avoid falling apart.

I claim:

1. A foldable cutting mat comprising:

a folding face having a first side face and a second side face and a first folding line that connects the first side face with the second side face;

a flipping face integrally and hingedly connected to said folding face, said flipping face having a first side plate and a second side plate and a first separating gap separating the first side plate and the second side plate such that the first side plate and the second side plate are not directly connected together, wherein the first side face and the first side plate are hingedly connected together by a second folding line, the second side face and the second side plate being hingedly connected together by a third folding line, wherein the first side face and the second side face are foldable relative to the first folding line between a first planar configuration and a first folded configuration, the first side face and the second side face overlying each, other in the first folded configuration, wherein the first side plate is foldable relative to the first side face about the second folding line between a second planar configuration and a second folded configuration, the first side plate and the first side face overlying each other in the second folded configuration, wherein the second side plate is foldable relative to the second side face about the third folding line between a third planar configuration and a third folding configuration, the second side plate overlying the second side face in the third folded configuration, the foldable cutting mat being entirely planar when the first side face and the second side face and the first side plate and the second side plate are in the first planar configuration and the second planar configuration and the third planar configuration, each of the first side face and the second side face and the first side plate and the second side plate being of generally equal areas, wherein the first side plate and the second side plate of said flipping face respectively have a male locking portion and a female locking portion, the male locking portion adapted to be received within the female locking portion; and an elastic ring extendable around said folding face and said flipping face when the first side face and the second side face and the first side plate and the second side plate are in the first folding configuration and the second folded configuration and the third folded configuration, wherein said elastic ring is received by the male locking portion.

2. The foldable cutting mat of claim 1, wherein the male locking portion has a hook shape.

* * * * *